US009728386B1

(12) United States Patent
Knecht et al.

(10) Patent No.: US 9,728,386 B1
(45) Date of Patent: Aug. 8, 2017

(54) MASS ANALYSIS INSTRUMENTS AND METHODS

(71) Applicant: FLIR DETECTION, INC., Stillwater, OK (US)

(72) Inventors: Brent Knecht, Lebanon, IN (US); Gary Gentry, Lafayette, IN (US)

(73) Assignee: FLIR Detection, Inc., Stillwater, OK (US)

( * ) Notice: Subject to any disclaimer, the term of this patent is extended or adjusted under 35 U.S.C. 154(b) by 0 days.

(21) Appl. No.: 14/962,724

(22) Filed: Dec. 8, 2015

Related U.S. Application Data

(60) Provisional application No. 62/088,884, filed on Dec. 8, 2014.

(51) Int. Cl.

| | |
|---|---|
| ***H01J 49/26*** | (2006.01) |
| ***H01J 49/00*** | (2006.01) |
| ***H01J 49/02*** | (2006.01) |
| ***H01J 49/04*** | (2006.01) |

(52) U.S. Cl.
CPC ..... *H01J 49/0095* (2013.01); *H01J 49/0031* (2013.01); *H01J 49/022* (2013.01); *H01J 49/04* (2013.01)

(58) Field of Classification Search
CPC .. H01J 49/0095; H01J 49/0031; H01J 49/022; H01J 49/04; H01J 49/0072; H01J 49/26
USPC ..... 250/281, 282
See application file for complete search history.

(56) References Cited

U.S. PATENT DOCUMENTS

| | | | | |
|---|---|---|---|---|
| 4,066,894 | A | 1/1978 | Hunt et al. | |
| 4,136,280 | A | 1/1979 | Hunt et al. | |
| 4,377,745 | A | 3/1983 | Chang | |
| 2008/0073530 | A1 | 3/2008 | Jolliffe et al. | |
| 2015/0001390 | A1* | 1/2015 | Collings | H01J 49/0027 250/282 |

* cited by examiner

*Primary Examiner* — Nicole Ippolito
(74) *Attorney, Agent, or Firm* — Wells St. John P.S.

(57) ABSTRACT

Mass spectrometry instruments are provided that are configured to provide dynamic switching between positive and negative ion preparation and analysis during a single sample analysis. Mass spectrometry analysis methods are also provided that can include switching between positive and negative ion preparation and analysis during a single sample analysis.

8 Claims, 5 Drawing Sheets

MASS ANALYSIS INSTRUMENTS AND METHODS

CROSS REFERENCE TO RELATED APPLICATION

This application claims priority to U.S. Patent Application Ser. No. 62/088,884 which was filed on Dec. 8, 2014, the entirety of which is incorporated by reference herein.

STATEMENT AS TO RIGHTS TO INVENTIONS MADE UNDER FEDERALLY-SPONSORED RESEARCH AND DEVELOPMENT

This invention was made with Government support under Contract HSHQDC-09-C-00057 awarded by the U.S. Department of Homeland Security. The Government has certain rights in the invention.

TECHNICAL FIELD

The present disclosure relates to mass analysis instruments and methods and in certain implementations dynamic mass analysis instruments and methods that can provide both positive and negative ion spectra from a single sample.

BACKGROUND

Mass analysis instruments are being utilized in laboratories as well as the field. The field applications can be those that identify threats that range from criminal, security, and terrorist threats. These field applications take place in airport security, border security, and military settings. Mass analysis can provide the fastest, most detailed information about compositions. However, there is a need for even faster and more detailed information.

SUMMARY

Mass spectrometry instruments are provided that are configured to provide dynamic switching between positive and negative ion preparation and analysis during a single sample analysis.

Mass spectrometry instruments are also provided that can include: a processing and control unit coupled to: a sample inlet configured to receive a sample; and MS elements; with the processing and control unit is configured to analyze the sample using the MS elements in two configurations, the first of the two configurations being negative ionization preparation and analysis and the second of the two configurations being positive ionization preparation and analysis, the same sample being analyzed under both configurations.

Mass spectrometry analysis methods are also provided that can include switching between positive and negative ion preparation and analysis during a single sample analysis.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

The present disclosure provides mass spectrometers that can dynamically produce and analyze both positive and negative ions simultaneously. This can provide for enhanced detection and identification of targets, e.g. explosives and narcotics.

Figure 1:
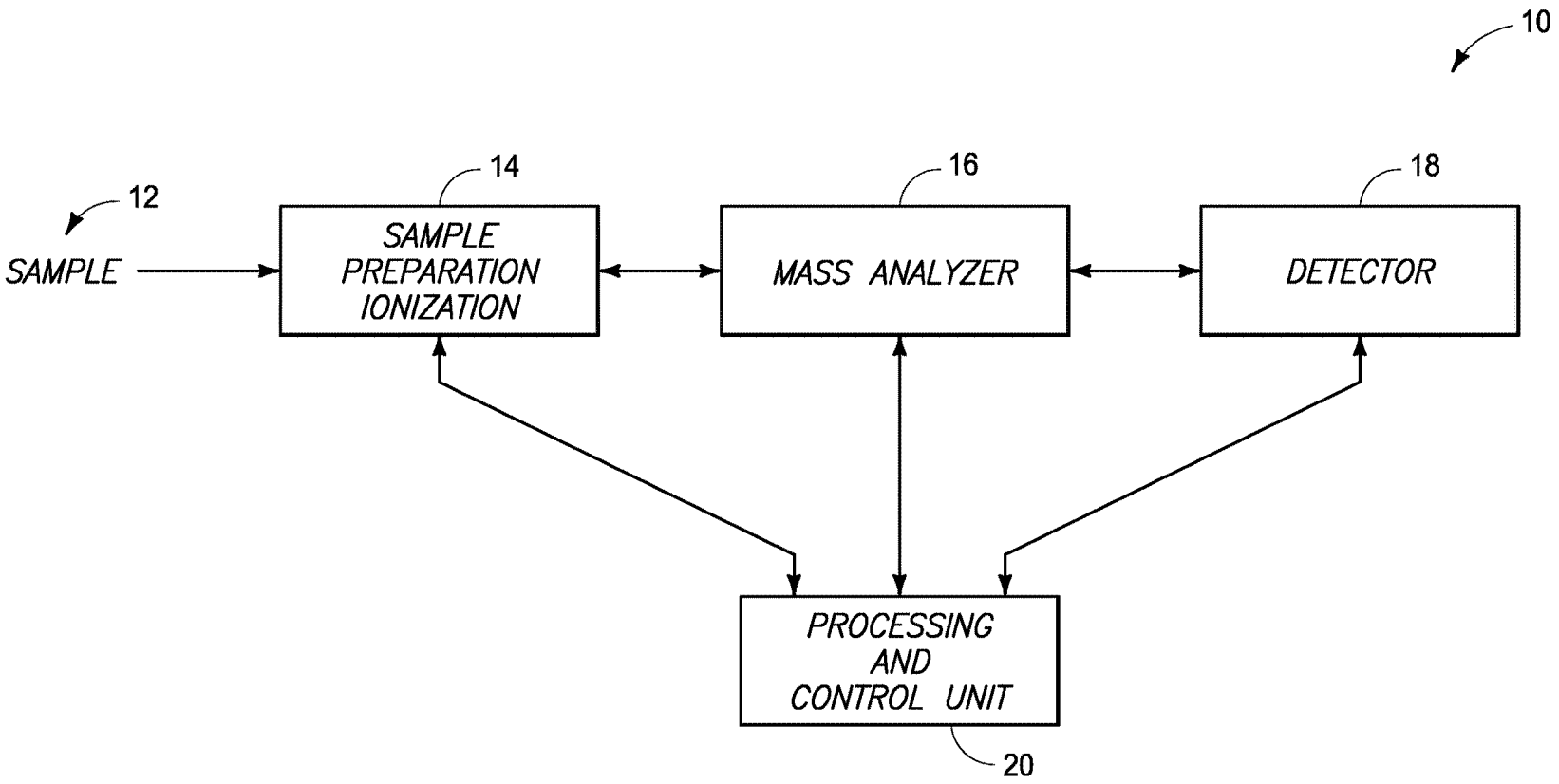
FIG. 1 is a block diagram of an instrument according to an embodiment of the disclosure.

The present disclosure will be described with reference to FIGS. 1-5. Referring first to FIG. 1, a block diagram of a mass spectrometry instrument is shown. Mass spectrometry instrument 10 includes a sample preparation ionization section 14 configured to receive a sample 12 and convey a prepared and/or ionized sample to a mass analyzer 16. Mass analyzer 16 can be configured to separate ionized samples for detection by detector 18. Mass analyzer 16 can include but is not limited to mass selection, mass filter, and/or mass separators.

As depicted in FIG. 1, a sample 12 can be introduced into section 14. For purposes of this disclosure, sample 12 represents any chemical composition including both inorganic and organic substances in solid, liquid and/or vapor form. Specific examples of sample 12 suitable for analysis include volatile compounds, such as toluene, or the specific examples include highly-complex non-volatile protein based structures, such as bradykinin. In certain aspects, sample 12 can be a mixture containing more than one substance or in other aspects, sample 12 can be a substantially pure substance. Analysis of sample 12 can be performed according to exemplary aspects described below.

Sample preparation ionization section 14 can include an inlet system (not shown) and an ion source (not shown). The inlet system can introduce an amount of sample 12 into instrument 10. Depending upon sample 12, the inlet system may be configured to prepare sample 12 for ionization. Types of inlet systems can include batch inlets, direct probe inlets, chromatographic inlets, and permeable or capillary membrane inlets. The inlet system may be configured to prepare sample 12 for analysis in the gas, liquid and/or solid phase. In some aspects, the inlet system may be combined with the ion source.

The ion source can be configured to receive sample 12 and convert components of sample 12 into analyte ions. This conversion can include the bombardment of components of sample 12 with electrons, ions, molecules, and/or photons. This conversion can also be performed by thermal or electrical energy.

The ion source may utilize, for example, electron ionization (EI, typically suitable for the gas phase ionization), photo ionization (PI), chemical ionization, collisionally activated disassociation and/or electrospray ionization (ESI). For example in PI, the photo energy can be varied to vary the internal energy of the sample. Also, when utilizing ESI, the sample can be energized under atmospheric pressure and potentials applied when transporting ions from atmospheric pressure into the vacuum of the mass spectrometer can be varied to cause varying degrees of dissociation. Analyte ions can be prepared as described herein as positive analyte ions or negative analyte ions.

Analytes can proceed to mass analyzer 16. Mass analyzer 16 can include an ion transport gate (not shown), and a mass separator (not shown). The ion transport gate can be configured to gate the analyte beam of ions generated by the ion source. The ion transport gate can be configured to gate positive or negative analyte ions as generated from the ion source. The mass analyzer 16 can be any of those described in U.S. Pat. No. 7,582,867 issued Sep. 1, 2009, the entirety of which is incorporated by reference herein. However, the configuration of the mass analyzer is as described herein. For example, the mass analyzer may be configured with positive or negative voltages.

Analytes may proceed to detector 18. Exemplary detectors include electron multipliers, Faraday cup collectors, photographic and stimulation-type detectors. The detector can be configured as described herein with positive or negative voltages.

The progression of analysis from sample preparation and ionization 14 through mass analyzer 16 and to detector 18 can be controlled and monitored by a processing and control unit 20. Unit 20 can be configured to provide the specific configurations of the ion source, the ion transporter, the mass analyzer and the detector as described herein. These configurations can include the specific polarity of voltages applied to each component.

Acquisition and generation of data according to the present disclosure can be facilitated with processing and control unit 20. Processing and control unit 20 can be a computer or mini-computer that is capable of controlling the various elements of instrument 10. This control includes the specific application voltages and may further include determining, storing and ultimately displaying mass spectra. Processing and control unit 20 can contain data acquisition and searching software. In one aspect, such data acquisition and searching software can be configured to perform data acquisition and searching that includes the programmed acquisition of the total analyte count. In another aspect, data acquisition and searching parameters can include methods for correlating the amount of analytes generated to predetermined programs for acquiring data.

Many target compounds of mass spectral analysis favor ionization in one polarity over another; for example, many explosives favor production of negative ions, due to the high electronegativity of the nitrate functionality on the explosive molecule. Many narcotics, on the other hand, favor positive ionization. A system that is required to detect both explosives and narcotics, e.g. for homeland security or forensic applications, requires the ability to produce and analyze both polarities. Ideally, the instrument would be capable of producing and analyzing both polarities simultaneously, so that if a single sample had multiple threats, all threats would be identified. Current spectrometers do not have this capability.

The present disclosure provides electronics and power supplies that overcome this limitation by providing: fully adjustable voltage output over a range, e.g. −400 V to +400 V and any voltage in between; independent settings for the positive and negative voltage, e.g. the supply could be run at −300 V and +400 V; and capable of switching between the positive and negative setpoints in less than 20 milliseconds.

With this type of power supplies to drive the MS elements, the instrument can switch between positive and negative analysis on a timescale that is shorter than the MS analysis time. When a sample is presented, the instrument can acquire a positive spectrum over approximately 100 ms, then the voltages are switched and a negative spectrum is acquired over approximately 100 ms. This cycle is repeated for as long as necessary to analyze the sample. This provides MS data for both positive and negative ions dynamically from the single sample.

Figure 2:
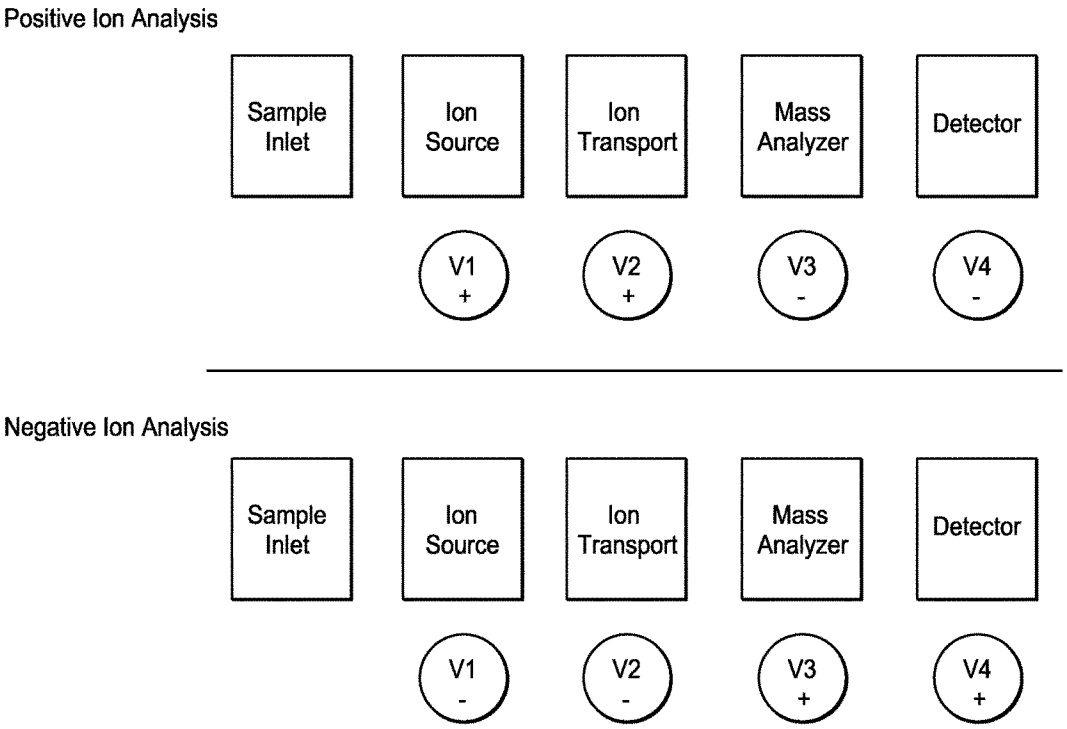
FIG. 2 depicts configurations of the instrument of FIG. 1 according to embodiments of the disclosure.

Some elements of the ionization source, the ion transport components, the mass analyzer, and the detector have DC voltages applied that are polarity-specific; i.e. they can be of opposite polarity depending on whether positive or negative ions are being analyzed. A block-diagram example of configurations of an instrument with DC voltages applied to various components is shown in FIG. 2.

As shown, opposite voltage polarity for positive vs. negative can be provided. In accordance with other implementations, a DC voltage on a given element can be a different value for positive vs. negative ions. For example, on an element of the ion transport component, the optimum voltage for positive ions may be −20 V, while for negative ions it may be +25 V. Instruments of the present disclosure can include power supplies having full adjustability over this output range for example, and/or independent setpoints for positive and negative modes.

Mass analysis instruments can complete the cycle of ionization, transport, analysis, and detection on a time-scale that is on the order of 100 ms. Some sample inlet methods present the sample to the analysis instrument for only a few seconds. It is desirable to collect as many mass spectra as possible over the course of the sample presentation to provide the maximum amount of information on the sample. The present disclosure provides instruments and methods that can collect both positive and negative spectra for a given sample within these time constraints. Instruments and method of the present disclosure can, for example, switch the MS components between their positive and negative setpoints, so that minimum analysis time is lost during the switching.

The instruments of the present disclosure can utilize a digital and analog power supply providing for adjustability, independent setpoints, and switching. The instrument can be configured with fast-switching operational amplifiers or optical diode switches to provide DC voltages to the MS elements, combined with digital-to-analog converters (DACs) that provide the setpoint information to the amplifiers/switches in real-time. This arrangement allows for power supplies that can switch up to +/−4000 V in ca. 20 ms. Block diagrams of two different version of the power supply are shown in FIGS. 3 and 4.

Figure 3:
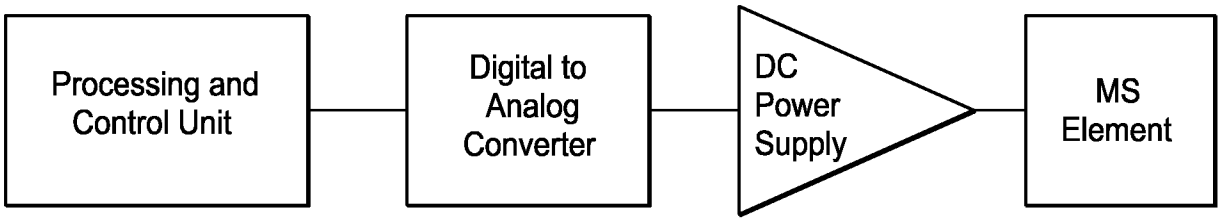
FIG. 3 is a depiction of components of the instrument of FIG. 1 according to embodiments of the disclosure.

In the configuration shown in FIG. 3, the Processing and Control Unit is used to specify the desired voltage for the MS elements. The Unit can be configured to provide a digital signal that defines the voltage level to the Digital to Analog Converter (DAC) for each element. The DAC converts the digital signal to an analog control signal that is used to set the output of the DC power supply to the desired voltage. The DC power supply is based on a fast-switching operational amplifier (Op Amp). Because the Unit and the DAC are digital, they can change the control signal between the settings for positive ions and negative ions in a few microseconds. The Op Amp can provide switching between voltages of up to +/−400 V in less than 20 ms and allow for the required fast polarity switching.

Figure 4:
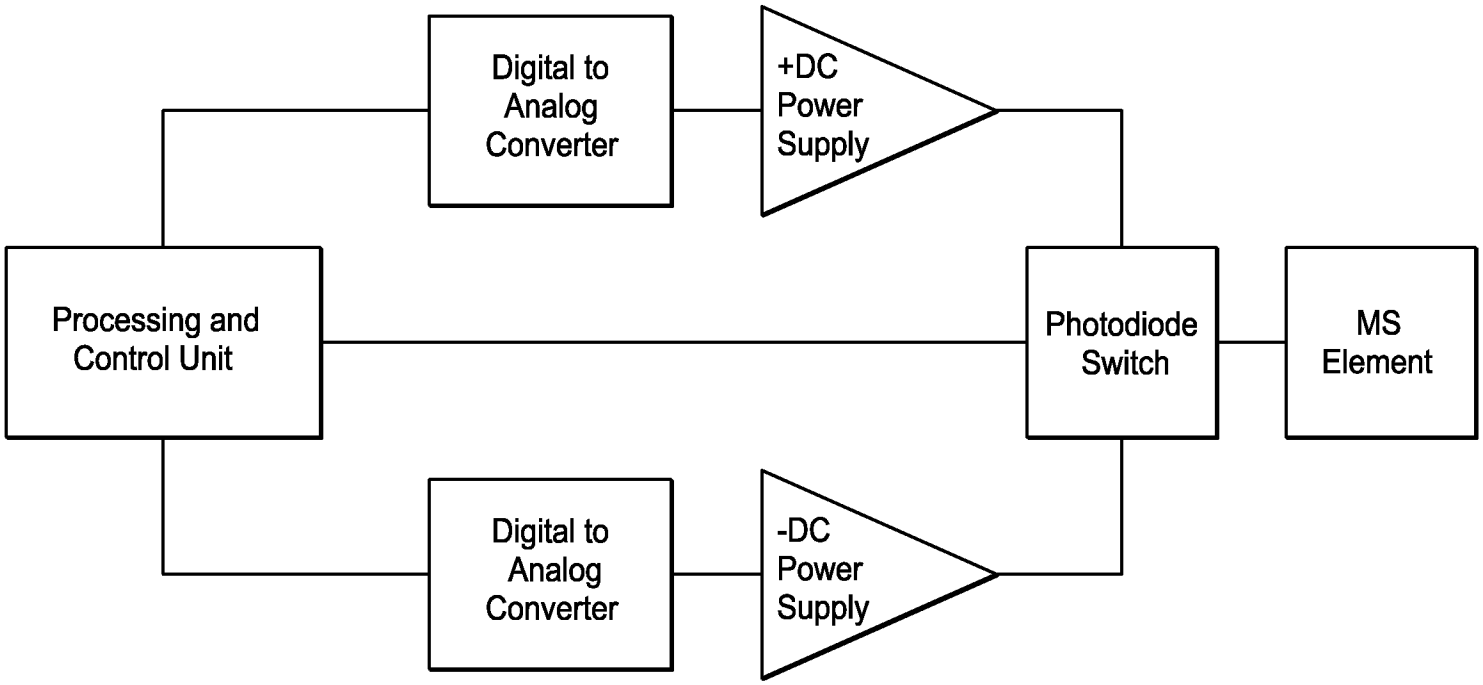
FIG. 4 is another depiction of components of the instrument of FIG. 1 according to another embodiment of the disclosure.

If voltages higher than +/−400 Volts are required, a second version of the invention can be used, as shown in FIG. 4, for example. With the embodiment shown in FIG. 4, two DAC/power supply combinations are used for the MS element; one for the positive ion voltage setting, and one for the negative ion setting. The Processing and Control Unit can provide the digital signal for the two settings to the two DACs, which again convert the signals to analog control signals for the DC power supplies. In this embodiment, the power supplies can be connected to a photodiode switch, which is in turn connected to the MS element. The Processing and Control Unit controls the switch, making it switch between the positive power supply and the negative power supply at the appropriate time. In this arrangement, power supplies of up to 4000 V can be used. The photodiode switch is able to switch between up to +/−4000 V in less than 20 ms. According to example implementations, six DC supplies can be utilized for the embodiment shown in FIG. 3, and one supply for the embodiment shown in FIG. 4, for example.

Figure 5:
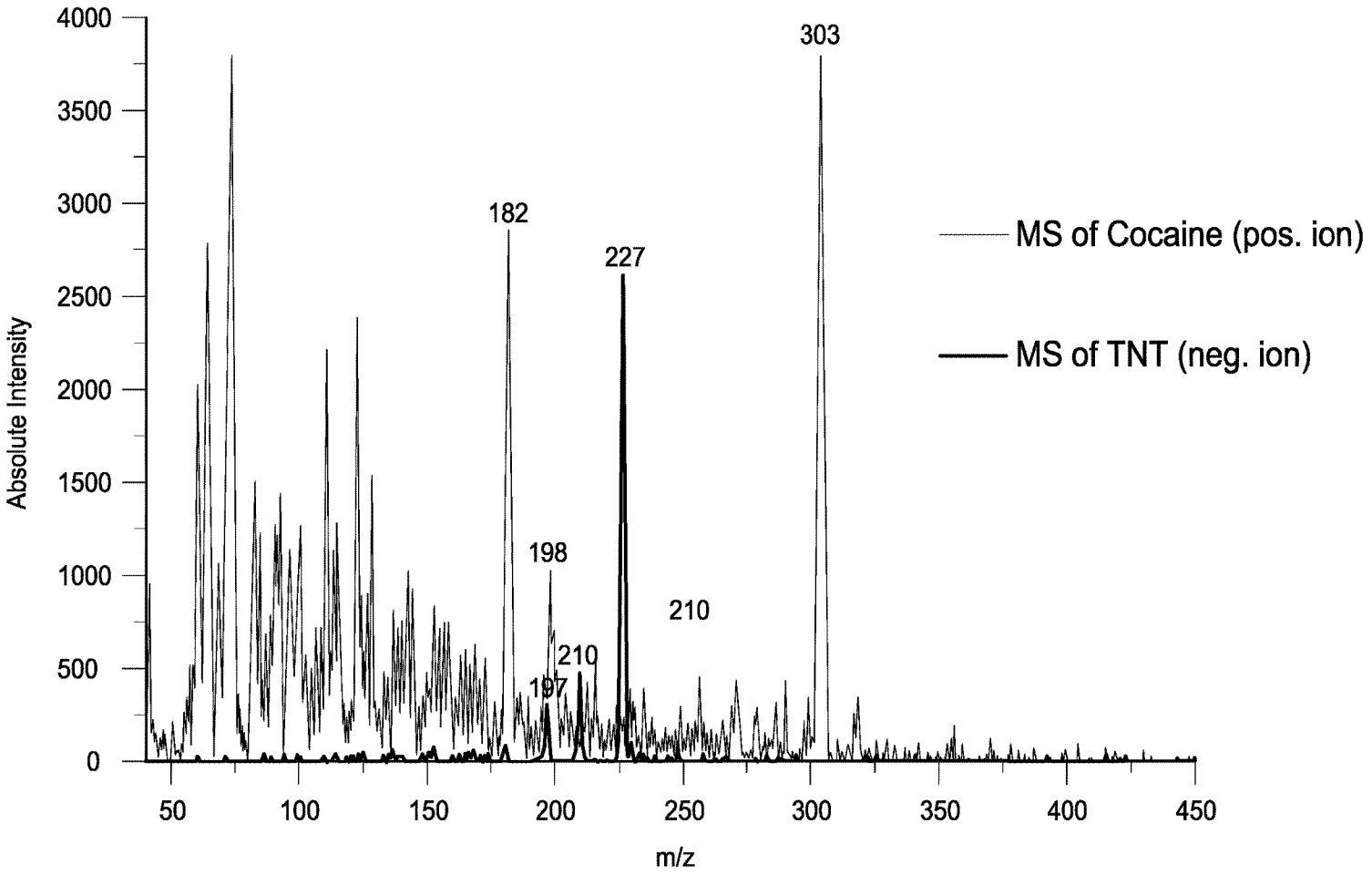
FIG. 5 is mass spectral data acquired using the instruments and methods of the present disclosure.

FIG. 5 illustrates data collected using an instrument configured with chemical ionization source, DC lenses for ion transport, a linear ion trap, and conversion dynode/electron multiplier detector. The DC lenses, components of the LIT, and the conversion dynode of the detector all utilize polarity switching.

A mixture of TNT and cocaine was deposited on a sample ticket and presented to the instrument through its thermal desorber inlet. As shown, a negative ion mass spectrum for the TNT and a positive ion mass spectrum for the cocaine were collected from the single sample.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A mass spectrometry instrument configured to provide dynamic switching between positive and negative ion preparation and analysis during a single sample analysis; the instrument comprising a processing and control unit operationally coupled to a digital to analog converter that is operationally coupled to a direct current power supply for at least one MS element.

2. The mass spectrometry instrument of claim 1 wherein the digital to analog converter is configured to convert the digital signal to analog signal, the analog signal being used to set the output of the direct current power supply.

3. The mass spectrometry instrument of claim 1 wherein the processing and control unit is operationally coupled to a pair of digital to analog converters with each of the digital to analog converters being configured to convert the digital signal to analog signal, and the analog signal being used to set the output of individual ones of a pair of direct current power supplies, the instrument further comprising a photodiode switch between the individual ones of the pair of power supplies and the at least one MS element.

4. The mass spectrometry instrument of claim 1 having at least two ionization configurations, the first configuration comprising the MS elements in the positive ion analysis configuration, and the second of the configurations comprising the MS elements in the negative ion analysis configuration.

5. The mass spectrometry instrument of claim 4, wherein each of the two configurations are performed in a sequence with each sequence being at least 20 ms.

6. The mass spectrometry instrument of claim 1 wherein the power supply is configured to provide power over the range of −4000V to +4000V.

7. A mass spectrometry instrument comprising:

a processing and control unit coupled to:

a sample inlet configured to receive a sample;

a digital to analog converter;

a direct current power supply via the digital to analog converter; and one or more MS elements via the direct current power supply;

wherein the processing and control unit is configured to analyze the sample using the MS elements in two configurations, the first of the two configurations being negative ionization preparation and analysis and the second of the two configurations being positive ionization preparation and analysis, the same sample being analyzed under both configurations.

8. The mass spectrometry instrument of claim 7 wherein the MS elements include one or more of an ion source; ion transport; mass analyzer, and/or detector.

* * * * *